US006513624B2

(12) United States Patent
Coffin

(10) Patent No.: US 6,513,624 B2
(45) Date of Patent: Feb. 4, 2003

(54) LOUDSPEAKER ENCLOSURE

(76) Inventor: C. Ronald Coffin, 18 John's La., Topsfield, MA (US) 01983

( * ) Notice: Subject to any disclaimer, the term of this patent is extended or adjusted under 35 U.S.C. 154(b) by 0 days.

(21) Appl. No.: 09/776,359

(22) Filed: Feb. 2, 2001

(65) Prior Publication Data

US 2001/0037910 A1 Nov. 8, 2001

Related U.S. Application Data

(60) Provisional application No. 60/180,080, filed on Feb. 3, 2000, and provisional application No. 60/184,479, filed on Feb. 23, 2000.

(51) Int. Cl.[7] ..... A47B 81/06

(52) U.S. Cl. ..... 181/199; 181/148; 181/153; 181/196; 181/198

(58) Field of Search ..... 181/199, 198, 181/200, 148, 153, 196

(56) References Cited

U.S. PATENT DOCUMENTS

| | | | | | |
|---|---|---|---|---|---|
| 3,832,499 | A | | 8/1974 | Heil | 179/115.5 |
| 4,056,697 | A | | 11/1977 | Heil | 179/115.5 |
| 4,107,479 | A | | 8/1978 | Heil | 179/116 |
| 4,144,416 | A | | 3/1979 | Babb | 179/115.5 |
| 4,502,149 | A | | 2/1985 | Gefvert | 381/24 |
| 4,580,654 | A | * | 4/1986 | Hale | 181/146 |
| 4,655,315 | A | * | 4/1987 | Saville | 181/153 |
| 4,957,184 | A | | 9/1990 | Negishi | 181/153 |
| 5,000,286 | A | | 3/1991 | Crawford et al. | 181/145 |
| 5,082,084 | A | * | 1/1992 | Ye-Ming | 181/153 |
| 5,092,424 | A | | 3/1992 | Schreiber et al. | 181/145 |
| 5,111,905 | A | | 5/1992 | Rodgers | 181/152 |
| 5,191,177 | A | * | 3/1993 | Chi | 181/153 |
| 5,218,175 | A | | 6/1993 | Scarlata | 181/141 |
| 5,266,752 | A | | 11/1993 | Cussans | 181/155 |
| 5,313,525 | A | | 5/1994 | Klasco | 381/159 |
| 5,646,378 | A | | 7/1997 | Van Haaff et al. | 181/30 |
| 5,696,357 | A | | 12/1997 | Starobin | 181/156 |
| 5,864,100 | A | * | 1/1999 | Newman | 181/156 |
| 5,917,923 | A | | 6/1999 | Caron et al. | 381/345 |
| 5,937,074 | A | | 8/1999 | Carver | 381/395 |

* cited by examiner

*Primary Examiner*—Shih-Yung Hsieh
(74) *Attorney, Agent, or Firm*—George A. Herbster

(57) ABSTRACT

A modularized loudspeaker enclosure having an open-ended enclosure body, a loudspeaker support at one open end and an end structure at the other end. The enclosure body can be modified to alter the volume of the enclosure. A finally assembled enclosure can be sealed or ported. In one embodiment, the enclosure body includes a cylindrical tube cut to a length that provides a desired volume. In another embodiment the enclosure comprises standard corner, wall and end structures that constitute a component set for a constant length enclosure that can have different cross section areas.

15 Claims, 7 Drawing Sheets

LOUDSPEAKER ENCLOSURE

This application claims the benefit of provisional application No. 60/180,080 filed Feb. 3, 2000 and No. 60/184,479 filed Feb. 23, 2000.

BACKGROUND OF THE INVENTION

1. Field of the Invention

This invention generally relates to audio loudspeaker systems and more specifically to loudspeaker systems including loudspeakers and enclosures.

2. Description of Related Art

A continuing effort is being applied to the development of loudspeakers and their enclosures for producing audio loudspeaker systems that produce high-quality sound and that operate with maximum efficiency. This effort, in part, has been directed to developing different loudspeaker enclosures with sealed chambers, vented or ported chambers and acoustic waveguides, particularly for optimizing the performance of bass loudspeakers, woofers and sub-woofers.

My U.S. Pat. No. 4,595,801 and U.S. patent application Ser. No. 09/251,815 filed Feb. 17, 1999 disclose a dual cone loudspeaker with a primary annular speaker cone similar in function to a conventional dynamic loudspeaker mounted on a frame with a magnet structure adapted for operation as a bass loudspeaker or driver. A secondary speaker cone mounts to a sub-frame on the back of the magnet structure and connects to the primary speaker cone through a rigid coupling device so the primary and secondary speaker cones move in unison. Sound waves from the secondary speaker cone travel through an orifice extending through a center pole piece of the magnet structure and the primary speaker cone radiating in the same direction as sound waves from the primary speaker cone. Consequently for a given excursion of the primary speaker cone my dual cone structure generates a sound having a greater sound volume than the primary cone alone by virtue of the simultaneous excursions of both the primary and secondary speaker cones that move a greater air volume for a given speaker cone displacement.

This dual cone speaker can be mounted in a number of conventional enclosures with good results. However, it has been found that mounting the speaker in some enclosures can detract from the performance of the dual cone loudspeaker especially when the combination of the enclosure and the loudspeaker impedes the performance of the loudspeaker. What is needed is an audio loudspeaker system with an enclosure and a dual or single cone loudspeaker that will exhibit a reasonably flat response over a wide frequency range, particularly including bass frequencies.

As known, speakers come in different sizes and have different performance characteristics and require differently sized enclosures. Moreover, differently sized enclosures may also enhance the performance of a given speaker, as by altering a resonant frequency, for different applications. In the prior art, however, speaker enclosures are custom designed for each size. This means that anyone producing differently sized enclosures of the same basic design must obtain and inventory special components for each size. There is little, if any, parts commonality from one speaker enclosure to another.

SUMMARY

Therefore it is an object of this invention to provide a loudspeaker system with an enclosure that is adapted to the characteristics of loudspeakers including dual-cone loudspeakers.

Another object of this invention is to provide a loudspeaker system with an enclosure that enhance the performance of loudspeakers including dual cone loudspeakers.

It is another object of this invention to provide a loudspeaker system with a modularized enclosure adapted for providing differently sized speaker enclosures.

Still another object of this invention is to provide a standard set of components that can be assembled into a customized modular enclosure for a loudspeaker.

In accordance with one aspect of this invention, a modular enclosure for a loudspeaker includes an open-ended, closed sided, variable volume enclosure body, a loudspeaker support structure and an end structure. The enclosure body is readily modified to provide a desired enclosure volume.

In accordance with another aspect of this invention, it is possible to build a modular loudspeaker enclosure from a component system that includes preformed corner structures, intermediate structures, a loudspeaker support structure and an end structure. Each intermediate wall structure has a length corresponding to the length of the corner structures and is taken from a set comprised of different widths. The preformed corner and intermediate structures thereby can be formed into an open-ended, enclosed structure lying along an axis and having a cross section determined by the selection of the intermediate structures. The end structure closes one open end. The loudspeaker support structure spans the other open end and is adapted for carrying at least one loudspeaker.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
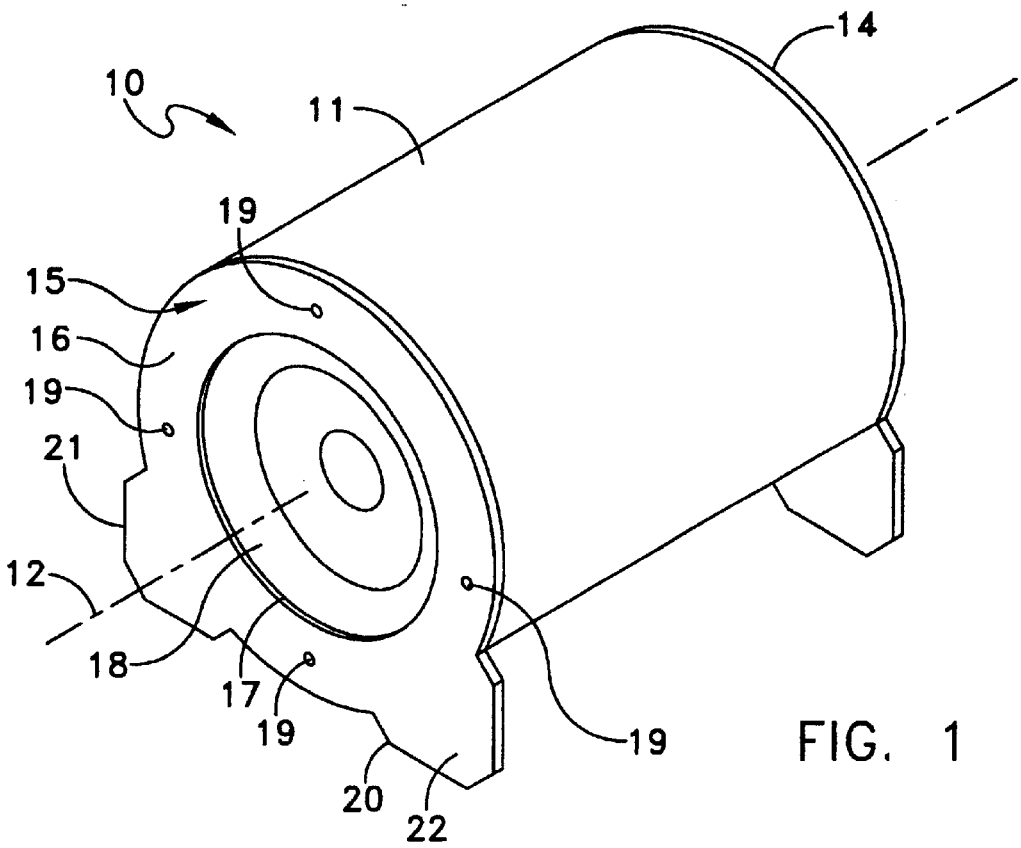
FIG. 1 is a perspective view of a sealed loudspeaker enclosure constructed in accordance with this invention.

FIG. 1 depicts a loudspeaker enclosure 10 constructed in accordance with this invention that includes an open-ended, closed side cylindrical body 11 formed along an axis 12. An end structure in the form of a radial plate 14 closes one end of the body 11. A loudspeaker support structure, in the form of a transverse plate 15, spans the other end 16 of the cylindrical body 11. The annular plate 15 provides a passage 17 in which sound from a loudspeaker 18 mounts. Fasteners 19 attach the loudspeaker 18 to the annular plate 15 in a conventional manner.

FIG. 1 is adapted for modular construction. The enclosure body 11 can be formed of tubing having a diameter sized for a particular speaker size. For example, the enclosure body could be formed of an 18" diameter tube for a 15" speaker. With such a fixed diameter enclosure body, volume adjustments are made by selecting the axial length of the tube. Typically tubing is supplied in long lengths, so cutting a specific length is a simple task. An 18" diameter tube produces a variable volume of 4 liters per inch of length. The cylindrical enclosure body 11 provides an extremely rigid structure. When the loudspeaker 18 with the plate 15 and a solid end 14 structure are mounted to the open tube ends, the resulting chamber is sealed.

Figure 2:
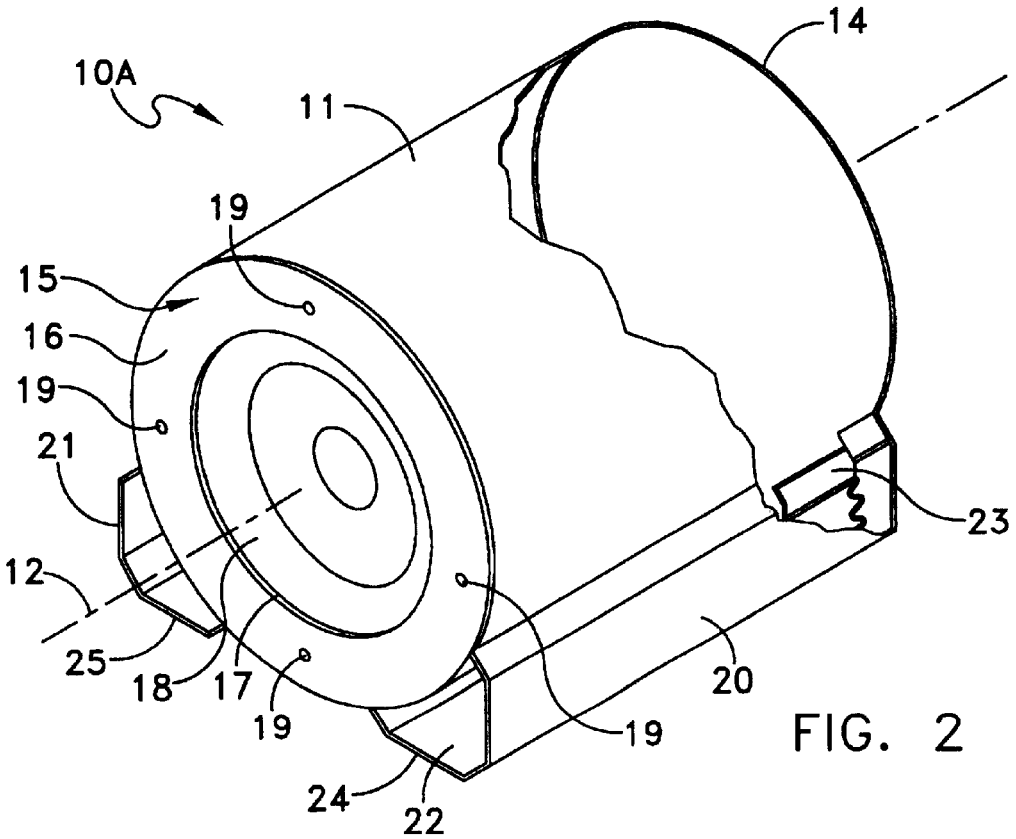
FIG. 2 is a perspective view of a ported loudspeaker enclosure that is a variation of the loudspeaker enclosure shown in FIG. 1.

FIG. 2 depicts two identical structures in the form of axially extending members 20 and 21 on the exterior of the enclosure body 11. Each includes an end metal structure with a polygonal cross section that may be open to the front of the loudspeaker 18 or closed. The openings or passages, like a passage 22 in the member 20, may be closed by a plug or by sloped extensions on the loudspeaker support structure or plate 15. In this embodiment, the members 20 and 21 act as feet or prevent the speaker enclosure 10 from rolling.

The loudspeaker enclosure 10A of FIG. 2 also is a ported version of the loudspeaker enclosure 10 in FIG. 1. The loudspeaker 10A has the same modular structure as shown in FIG. 1. However, the enclosure 10A is ported. More specifically, in FIG. 2 both members 20 and 21 provide paths from the interior of the enclosure body 11. At the rear of the passage 22, the interior of the member communicates with the chamber through a radially-opening passage 23. This same approach is used on the opposite side with the member 21, so the system provides two forward-directed ports from the chamber within the enclosure body 11.

FIG. 2 shows ports that extend along the entire length of the loudspeaker 10A. Other steps could be taken to reduce that distance. For example, the passage 23 could be moved forward to provide a passage to the chamber at an intermediate position along the length of the port structure 20 by blocking the volume to the rear or right in FIG. 2 of the passage 23. FIG. 2 discloses a simple passage through the cylindrical surface of the cylinder. The passage could also be constituted by a radial or other shaped closed structure that would constitute an extension of the passage 22 internally of the chamber as by being mounted on the interior of the back wall 13. In still another approach, a corner reflector could be placed proximate the rear corner of each of the port structures to facilitate the transfer of soundwaves from the chamber through the ports. As will be apparent there any many other variations of port structures that could be substituted for those specifically disclosed in FIGS. 1 and 2.

The structures in FIGS. 1 and 2 provide loudspeaker enclosures that are compact in size with respect to many other enclosures that provide comparable results. The diameter is a function of the loudspeaker diameter. The length is quite short in comparison to that diameter. In one particular embodiment a 15" diameter loudspeaker is mounted in an 18" diameter cylinder having a length of 18" with port structures, such as the port structures formed by members 21 and 22. Such a loudspeaker system has been found to provide good bass response and has also found a good response into the mid-range frequencies even with a 15" loudspeaker. The use of the members 20 and 21 facilitates the production of this enclosure because each member has the same structure and is easily cut to the right length.

Figure 3:
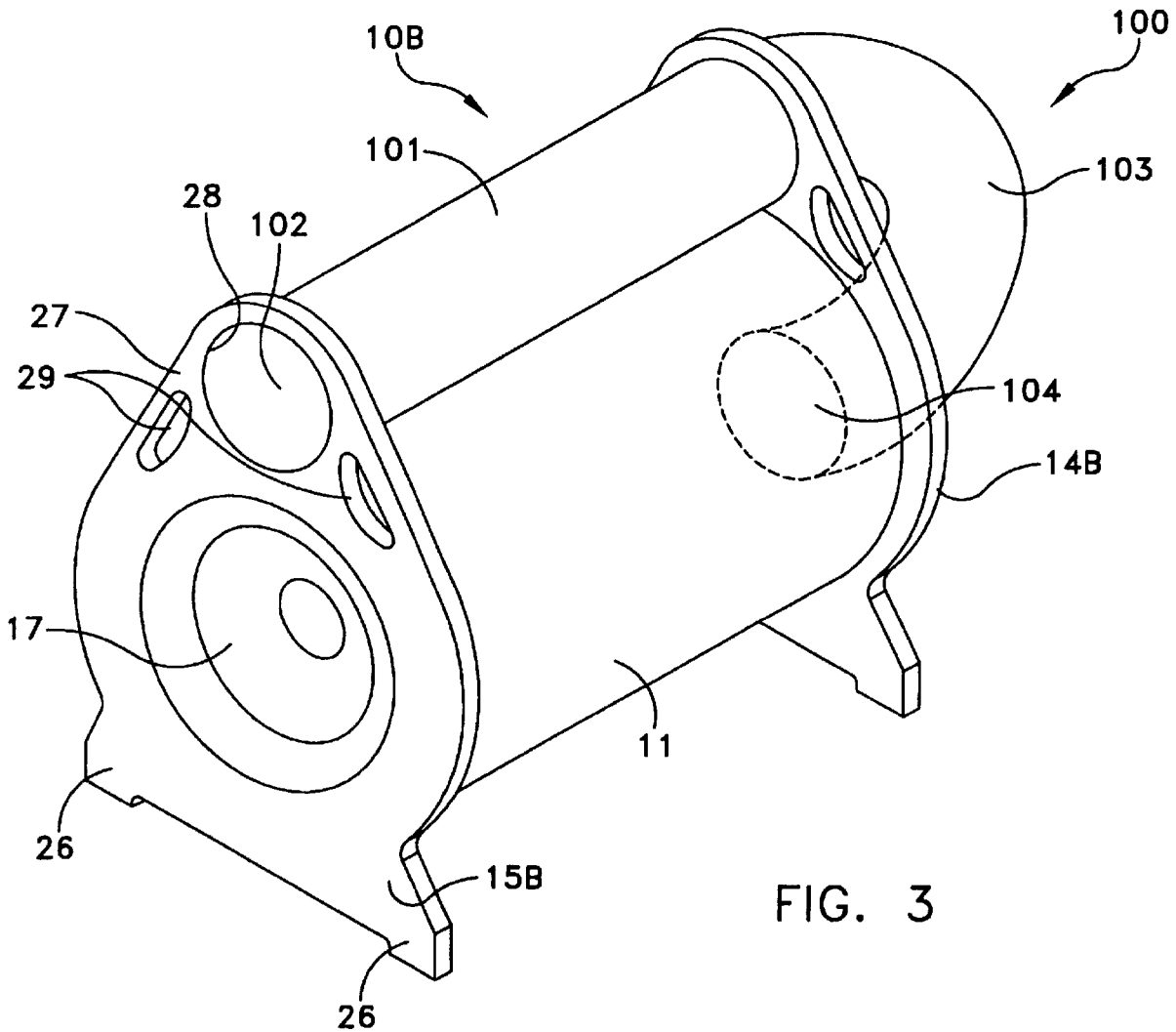
FIG. 3 is a perspective view of another ported loudspeaker enclosure that is a variation of the loudspeaker enclosure shown in FIG. 1.

FIG. 3 depicts still another variation of a loudspeaker enclosure 10B having the same basic modular form as shown in FIGS. 1 and 2. That is, the enclosure comprises a fixed diameter, open-ended enclosure body 11, a modified end structure 14B and a loudspeaker support structure 15B. Each of these structures can have the same basic construction whereby they are interchangeable.

Each of the structures 14B and 15B has angular spaced, radially extending feet 26 at the bottom. A radial extension 27 and the top has a central opening 28 and handholds 29. Both would be rabbeted to nest partially in the respective ends of the enclosure body 11 thereby to facilitate attachment. In FIG. 3, the loudspeaker support structure 15B contains an aperture or loudspeaker mounting hole 17 for receiving a loudspeaker.

The enclosure 10B has a single port 100. This port is formed by a straight tube portion 101 that extends through the opening 28 thereby to be formed integrally with the spaced structures 14B and 15B. The tube portion 101 has a front facing opening 102. A U-shaped tubular structure portion 103 connects the other end of the tube portion 101 to a corresponding shaped passage 104 in the end structure 14B. In use, a portion of the axially directed pressure waves will pass through the aperture 104 and be directed to exit the port at the front.

As will be apparent, this structure is adapted for modularity. The basic form of the loudspeaker support 15B and the end structure 14B are the same for a given diameter tube. It is merely necessary to size the apertures 17 and 104. Varying the length of the tubes 11 and 101 enables a custom volume to be provided.

FIGS. 4 through 11 depict modular loudspeaker enclosures and components for modular construction that provide the advantages of the loudspeaker enclosure 10 in FIGS. 1 through 3 and additional features that may be advantageous in many applications.

Figure 4:
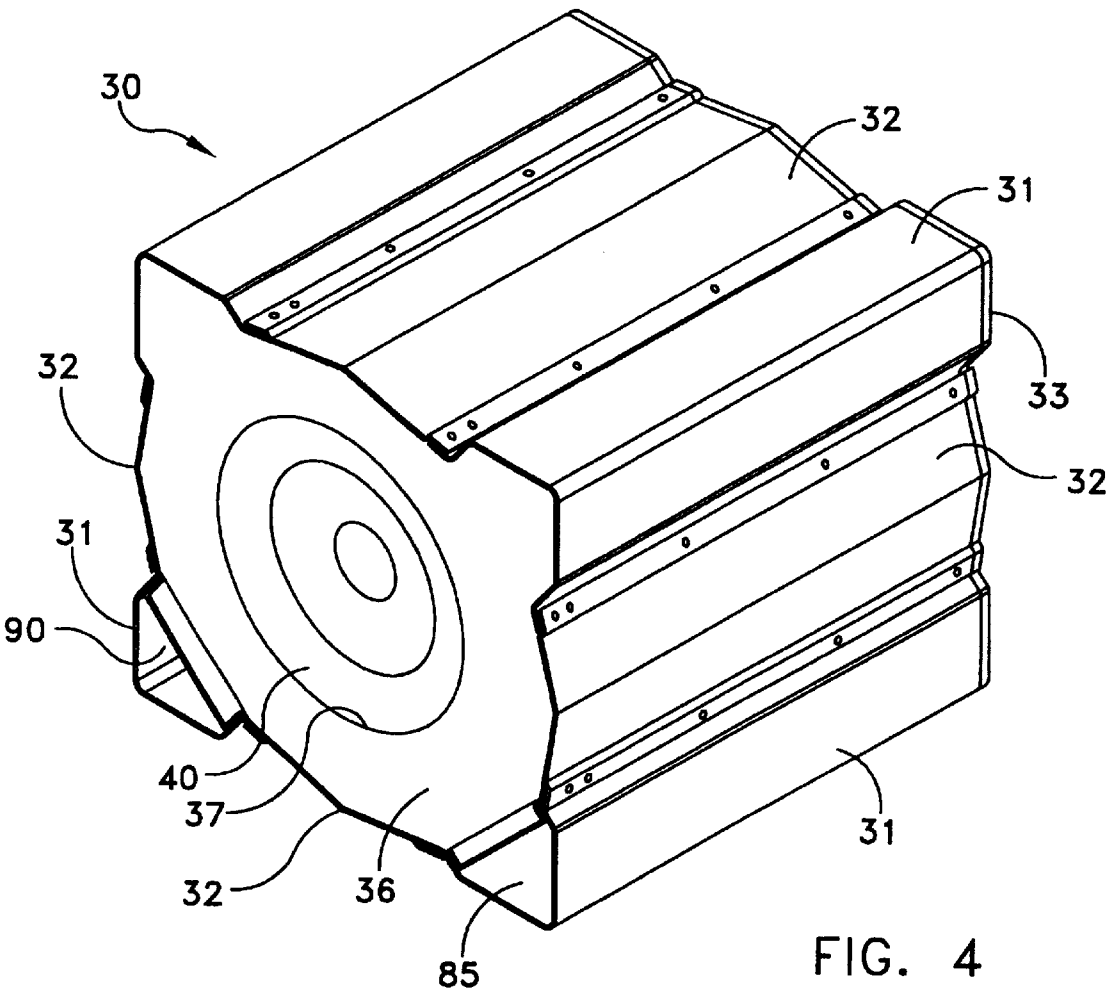
FIG. 4 is a perspective view, partially broken away, of an alternative embodiment of a loudspeaker system constructed in accordance with this invention.
Figure 5:
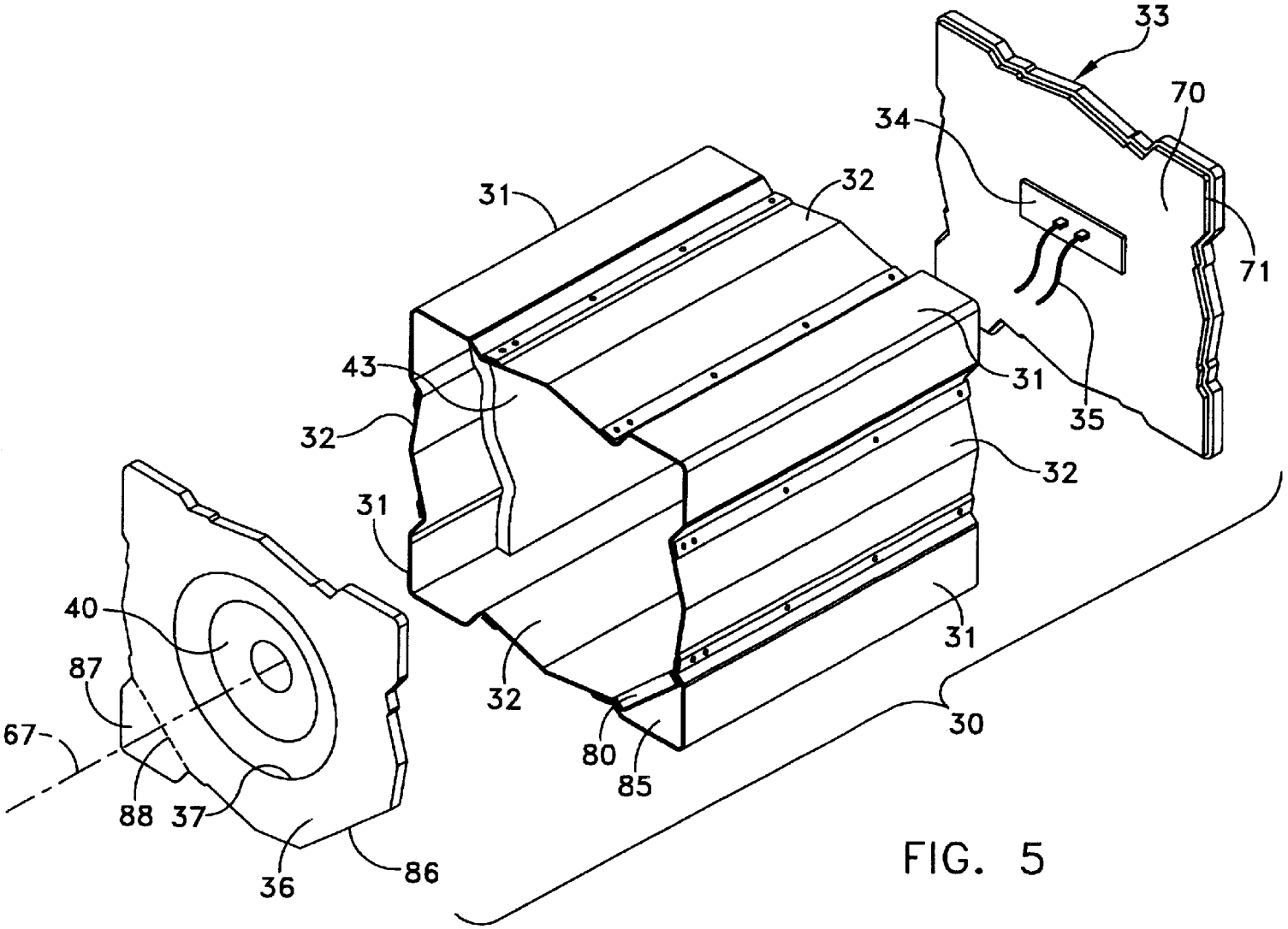
FIG. 5 is an exploded view of the enclosure for the loudspeaker system shown in FIG. 4.

More specifically, and referring specifically to FIGS. 4 and 5, a loudspeaker enclosure 30 in this embodiment includes four preformed corner structures 31 and a plurality of intermediate wall structures 32. The corner structures 31 and intermediate wall structures 32 interconnect to form an open-ended enclosed structure lying along an axis and having a predetermined cross section. An end structure, in the form of a plate 33, closes one of the ends of the loudspeaker enclosure 30, namely the back end. It includes a terminal structure 34 for allowing the connection of an amplifier to the loudspeaker and loudspeaker cables 35 that extend from the terminal 34 to a loudspeaker mounted on the other end.

A loudspeaker support structure in the form of another transverse plate 36 spans the other end of the enclosure, namely the front end. The transverse plate 36 has at least one annular opening 37 for receiving a loudspeaker 40. In FIG. 4 the loudspeaker is shown without any covering grill. Such a grill is optional.

Figure 7:
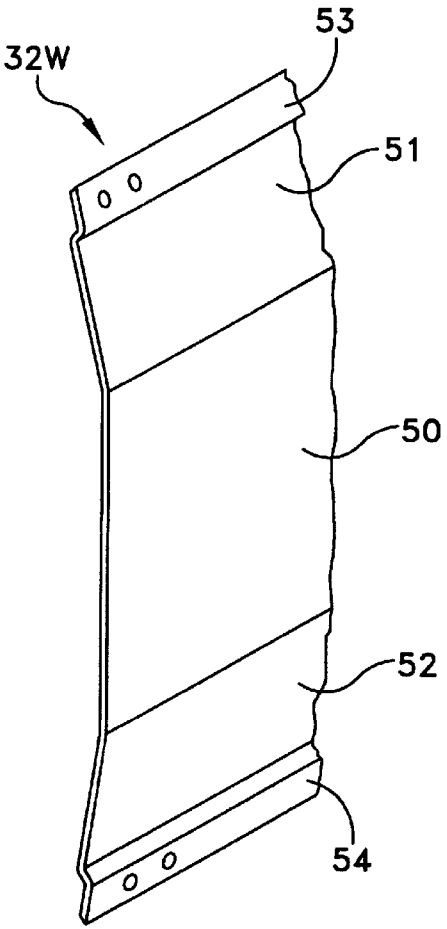
Figure 6:
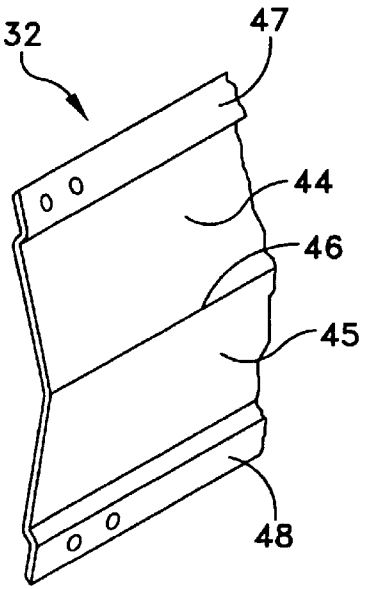

In accordance with this invention, the loudspeaker enclosure 30 shown in FIGS. 4 and 5 is formed from a set of modular components, namely, the corner structures 31, intermediate wall structures 32, end structures 33 and loudspeaker support structures 36. FIGS. 6 and 7 illustrate portions of two different intermediate wall structures that are two members of a family of intermediate wall structures.

More specifically, FIG. 6 depicts an intermediate wall structure 32 formed as a stamped sheet metal piece that is bent along a center line to form two planar panels 44 and 45 that lie in planes that intersect at an apex 46. At an edge remote from the apex 46, the panel 44 ends in an axially extending shoulder 47. A like shoulder 48 extends from the panel 45. The shoulders 47 and 48 overlap tongues on adjacent corner structures as described more fully hereinafter. In one specific implementation, intermediate wall portions having the form shown in FIG. 5 have widths of 12", 14" and 16".

For wider panels, or even as a substitute for the panels having the sizes of those shown in FIG. 6, an alternate structure can be used. With wide panels such an alternate structure is advantageous because as panel width increases, panel height increases, as measured from a plane across the shoulders 47 and 48 to the apex 46. As shown in FIG. 7, one alternative intermediate wall structure 32W includes a flat center panel 50. Side panels 51 and 52 lie in planes that intersect the plane of the center panel 50. A shoulder 53 lies parallel to the panels 50 and 51; a shoulder 54, parallel to the panels 50 and 52.

Thus in accordance with this aspect of the invention, it is possible for a manufacturer to have a set of differently sized intermediate wall structures such as shown in FIGS. 5 and 6 from which to pick and choose to design a loudspeaker enclosures having any desired dimension that can be provide an optimal enclosure size for different loudspeakers. Moreover, differently sized intermediate wall structures use in the same enclosure enable the construction of rectangular enclosures rather than the square enclosures shown in the various figures.

As previously indicated, the intermediate wall structures 32 interconnect the preformed corner structures 31. A corner structure 31 shown in FIG. 8 includes two sides 60 and 61 that extend along two sides of a triangle from an apex 62. The side 60 extends to an oblique offset planar portion 63 that carries a flange 64. The plane of the tongue intersects the plane of the oblique offset portion 63. A similar oblique section 65 and flange 66 are formed at the end of the wall 61.

Figure 8:
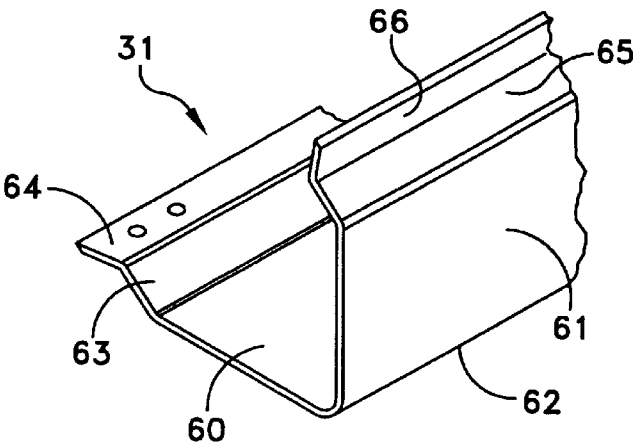
FIGS. 6 through 9 depict a number of components that can be utilized in the loudspeaker system shown in FIG. 4.

The offset angles of the various flanges 64 and 66 in FIG. 8 and shoulders 47 and 48 in FIG. 6 are not critical. Once a set of four intermediate wall structures and four corner structures has been identified, they are readily interconnected by applying a sealing material between the adjacent surfaces and by fastening the overlapping tongues and shoulders together with rivets, screws or other fastening devices. This provides an open-ended, closed sided enclosure that extends along an axis 67 as shown in FIG. 5.

The loudspeaker enclosure of FIGS. 4 and 5 is completed by adding the end structure 33 and the loudspeaker support structure 36. Referring specifically to FIG. 5, the end structure 33 is milled to have the same peripheral shape as the enclosure formed by the corner structures 31 and intermediate wall portions 32. In the preferred embodiment, the edge of the end structure 33 may be rabbeted so that a main panel portion 70 lies inside the enclosure while the rabbet 71 overlies the end edges of the various corner and intermediate wall structures. Screws or other fasteners can then be used to fix the end structure 33 in position and in a substantially sealed relationship with the corner and intermediate wall structures 31 and 32 to minimize the escape of any air from the interior of the enclosure 30 past the sealing structure 33.

If it is desired to have a non-ported loudspeaker enclosure, the loudspeakers support structure 36 has the same general outline as the sealing structure 33. That structure then is also located within the periphery of the enclosure 30 and affixed thereto. As will now be apparent, this construction provides an extremely rigid enclosure. The sealing structure 33 and the loudspeaker support structure 36 prevent the enclosure 30 from twisting about the axis 67. The bends formed in the each of the corner structures 31 and intermediate wall structures 32 act to stiffen the walls against radial deformation. Thus the volume defined within the enclosure 30 remains constant during use.

While such a loudspeaker enclosure 30 could be constructed without any ports, FIG. 5 depicts an enclosure 30 with a single port. The formation of such a port is more clearly understood while referring to FIGS. 9 through 11. As previously indicated each corner structure 31 is formed on essentially two sides of a triangle. If it is desired to incorporate a port into the system, a channel 80 as specifically shown in FIGS. 9 through 11, partially closes the third open side of the triangle to produce an axially extending triangular chamber.

The channel 80 includes a planar base 81 and two upstanding or edge portions 82 and 83 and flanges 82A and 83A that fasten to the flanges 63 and 65 to close the open side. With this construction, the depth of a channel 80, as defined by the depth of the upstanding portions, controls the cross-sectional area and hence the volume of the port structure. Other channel shapes could also be used to achieve variations in port cross section.

Figure 10:
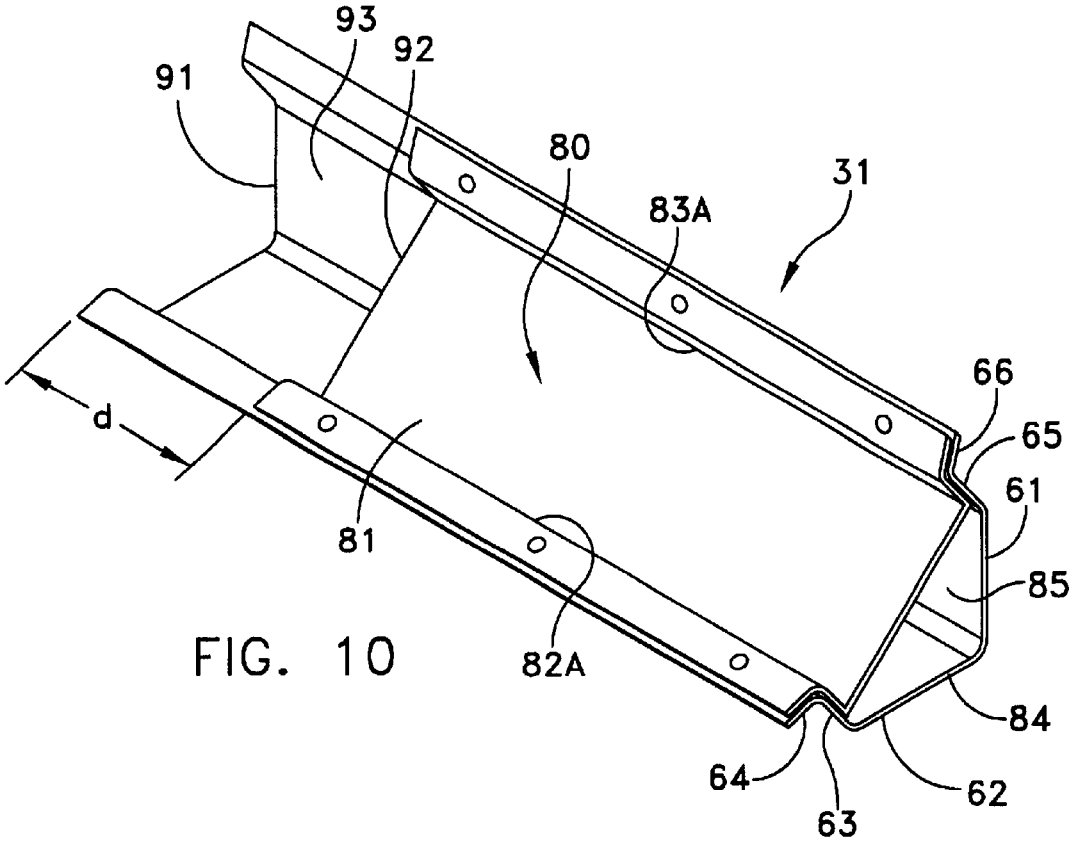
FIGS. 10 and 11 are two perspective views of a corner structure and port mechanism constructed in accordance with this invention.
Figure 11:
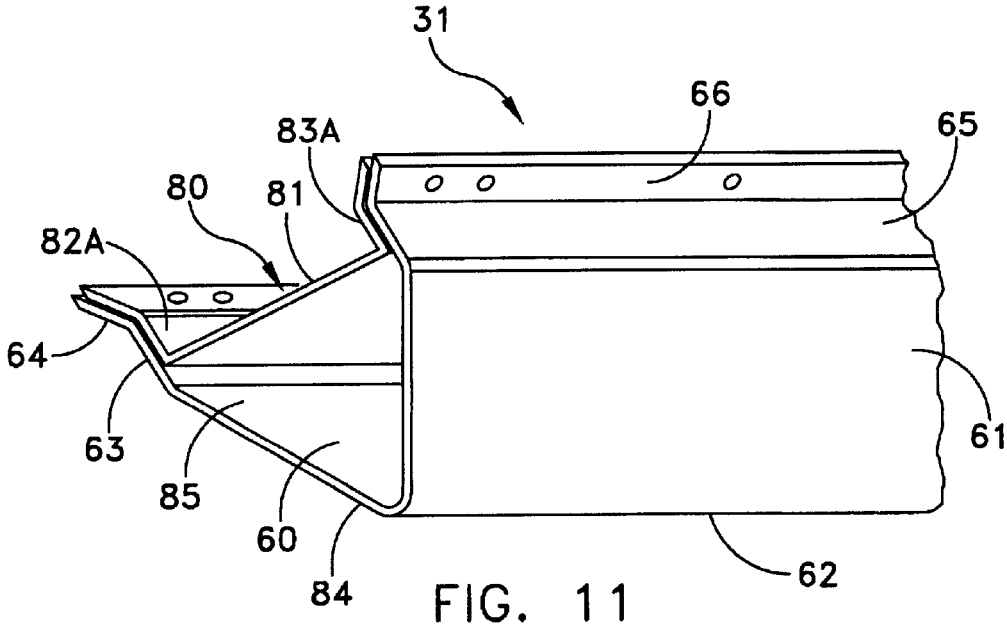

The channel member 80 extends from a position proximate a front end 84 of the corner structure 31. In FIG. 10 this defines a triangular port opening 85. When a port structure is to be included in the loudspeaker, one portion of the loudspeaker support 36 is removed. An example is shown in FIG. 5 wherein one corner has been removed or cutout to expose a diagonal edge 86 that will abut or lie along the plane of the central base plate 81 thereby to expose the opening 85. If a second port were desired at the other lower corner structure, a similar channel would be inserted in that corner structure and a cutout 87 would be removed along a cut line 88 of the loudspeaker support 36. The assembled enclosure then would have a second port extending from an opening 90 in FIG. 4.

Referring again to FIG. 10, the base plate 80 extends toward a rear edge 91 of the corner structure 31 with a rear edge 92 being spaced at a distance "d" from the rear edge 91. This produces a passage or radial opening 93 between the port chamber and the main enclosure chamber. The opening 93 may be direct as shown in FIG. 10. In other embodiments an extension or duct may extend from the opening 93 into another portion of the enclosure chamber. In still other embodiments, the base plate 80 could be located at the rear of the corner structure so that an opening corresponding to the opening 93 could be at the front of the enclosure to provide a rear opening port. In still other embodiments, the opening could be at some intermediate point thereby to enable the effective length of the port to be changed.

As a specific example, a single ported structure as shown in FIG. 5 has been produced having an axially length of 18" and a height and width of 18". The loudspeaker support 36 carried a 12" loudspeaker. The port had an area of $18"^2$. When driven with a dual cone loudspeaker as described in U.S. Pat. No. 6,343,128 the enclosure had a resonant frequency of 25 Hz and produced a pleasing quality of bass responses.

Figure 12:
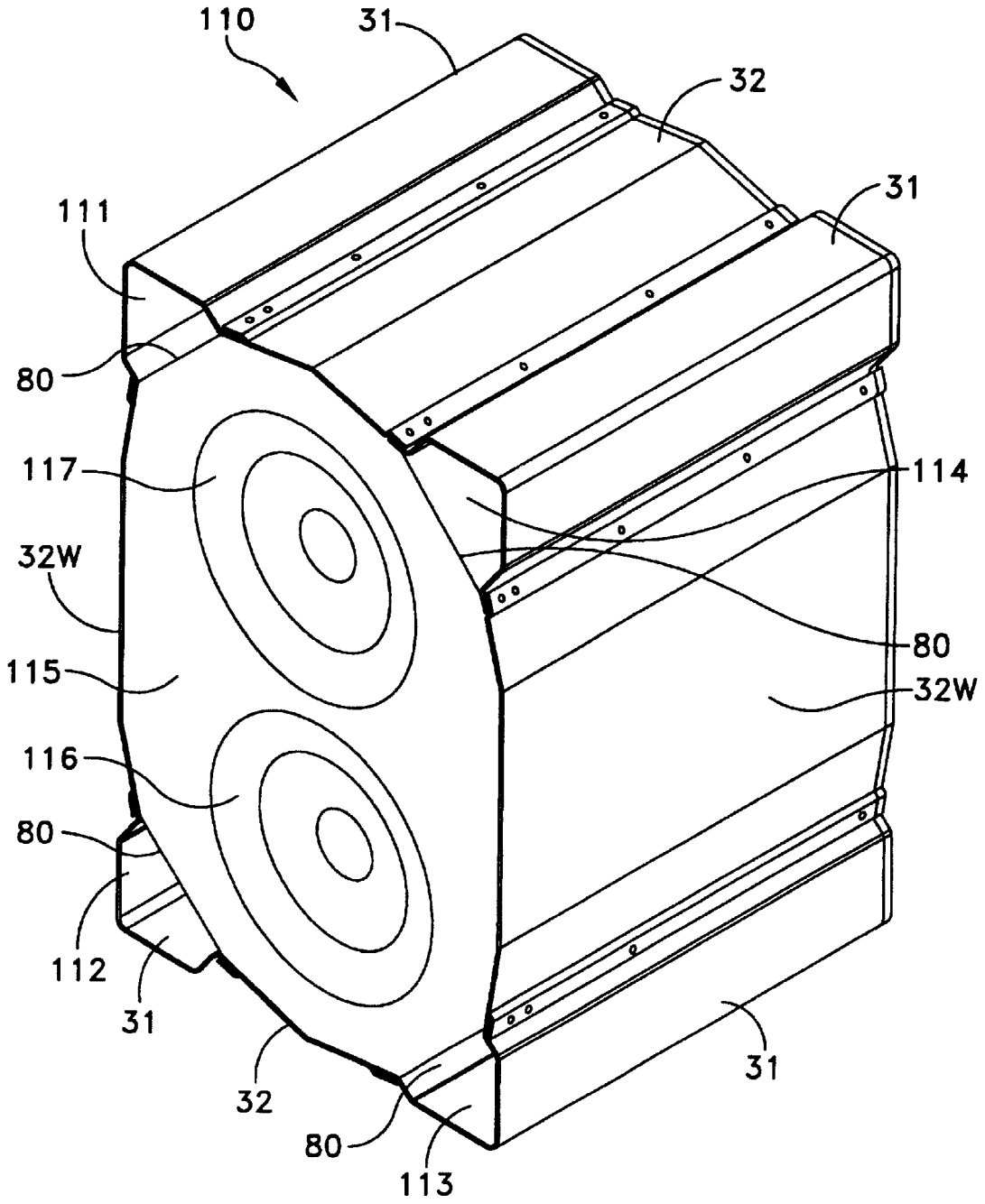
FIG. 12 depicts another embodiment of a loudspeaker system constructed in accordance with this invention.

FIG. 4 depicts an enclosure adapted for carrying a single loudspeaker. FIG. 12 depicts a loudspeaker enclosure 110 formed from the same set of components as shown in FIGS.

Figure 9:
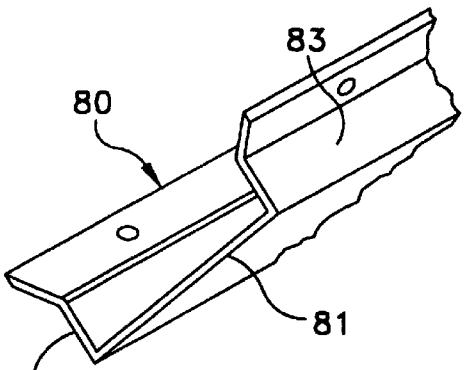

6 through 9 with four ports 111, 112, 113 and 114. A loudspeaker support structure 115 carries two loudspeakers 116 and 117. This modular enclosure comprises four corner structures 31, as shown in FIG. 8, two intermediate structures 32, as shown in FIG. 5, two intermediate structures 32*w*, as shown in FIG. 6, four channels 80, as shown in FIG. 9, an end structure 33 and a loudspeaker support structure 36. This particular enclosure has a length of 16" and a height 28" and width of 18" and carries two 12" loudspeakers. Each port has an area of $12"^3$. It has been found that this loudspeaker enclosure has a resonant frequency of 32 Hz and is well suited for use by a bass guitar musician.

As will now be more readily apparent, each of the loudspeaker systems shown in the figures provide a bass loudspeaker enclosure with enhanced performance characteristics particularly when including the dual cone loudspeaker described in my U.S. Ser. No. 09/251,815. Each specific embodiment disclosed in FIGS. 3 through 12 can be manufactured from a set of standard components that provide different configurations and enclosures of different volumes. The components shown in FIGS. 6 through 10 are not bulky. Consequently, it is also possible to ship and inventory stock for different enclosures in significantly less storage and shipping volumes over requirements that attend larger speakers. This structure is also readily adapted for shipment as a kit that can be assembled with simple hand tools.

While several embodiments of loudspeaker enclosures have been discussed, it will be apparent that many other modifications can be made to the specifically disclosed embodiments while attaining some or all of the advantages of this invention. For example, enclosures having two specific cross-sections have been disclosed. Certain modifications to those cross-sections could be made. The structure has been disclosed in terms of specific stamped sheet metal pieces. The use of appropriate extruded materials might also be substituted. Still other loudspeaker configurations could be included. Therefore, it is the intent of the appended claims to cover all such variations and modifications as come within the true spirit and scope of this invention.

What is claimed as new and desired to be secured by Letters Patent of the United States is:

1. A modular loudspeaker enclosure comprising:

A. an open-ended, closed sided, variable volume enclosure body extending along a speaker axis and defining first and second open ends thereof wherein said enclosure body comprises fixed-length corner structures that lie parallel to the speaker axis and intermediate panels attached to adjacent corner structures, said intermediate panels being selected from a set of constant length intermediate panels of different widths whereby the selection of intermediate panels determines the cross-sectional area and volume of said loudspeaker enclosure B. a loudspeaker support structure spanning a first of said open ends for carrying a loudspeaker, and C. an end structure closing the second of said open ends.

2. A modular loudspeaker enclosure as recited in claim 1 wherein said loudspeaker support structure includes at least one opening for receiving a loudspeaker and said end structure seals the other end of said enclosure whereby said loudspeaker support and end structures and said enclosure body form a sealed loudspeaker enclosure.

3. A modular loudspeaker enclosure as recited in claim 1 wherein said loudspeaker support structure includes at least one opening for receiving a loudspeaker and said enclosure additionally includes a port between the interior and exterior of said enclosure whereby said loudspeaker support and end structures, said enclosure body and said port form a ported enclosure.

4. A modular loudspeaker enclosure as recited in claim 3 wherein said port defines a path from the interior of said enclosure to the rear of said enclosure.

5. A modular loudspeaker enclosure as recited in claim 3 wherein said port defines a path from the interior of said enclosure to the front of said enclosure.

6. A modular loudspeaker enclosure as recited in claim 1 additionally comprising a plurality of ports, each port defining a path from the interior of to the exterior of said enclosure.

7. A component system for building a modular loudspeaker enclosure having one of a plurality of enclosure volumes, said component system comprising:

A. a plurality of preformed corner structures of a specific length, each said corner structure providing a surface for stabilizing said enclosure, B. a plurality of intermediate structures having a length corresponding to the length of said corner structures and having one of a predetermined number of widths, each of said corner and intermediate structures being adapted for being attached thereby to form an opened-end, closed sided enclosure body lying along an axis and having a predetermined length and a cross section area determined by the selection of said intermediate structures, C. an end structure for closing one of said open ends, and D. a speaker support structure for closing the other of said open ends and for supporting at least one loudspeaker thereon.

8. A component system as recited in claim 7 wherein certain intermediate structures include portions thereof lying in two intersecting planes and side shoulders for attachment to adjacent ones of said corner structures.

9. A component system as recited in claim 8 wherein each of said corner structures includes two side planar members that lie on two sides of a triangle and that terminate in side shoulders.

10. A component system as recited in claim 9 wherein other intermediate structures include portions thereof lying in three intersecting planes and terminating in side shoulders to attachment to adjacent ones of said corner structures.

11. A component system as recited in claim 7 wherein said components includes four of said preformed corner structures and four of said intermediate structures thereby to form a closed structure for receiving said speaker support and said end structures.

12. A component system as recited in claim 11 wherein each of said corner structures includes two side planar members that lie on two sides of a triangle and that terminate in side tongue portions and wherein each of said intermediate wall structures includes at least two planar portions lying in different planes and terminating in shoulders, said shoulder and tongues being overlapped to connect adjacent corner and intermediate structures in a formed enclosure.

13. A component system as recited in claim 12 additionally comprising a planar member with side support portions for attachment to one of said corner structures thereby to define a port.

14. A component system as recited in claim 7 additionally comprising a planar member with side support portions for attachment to one of said corner structures thereby to define a port.

15. A component system as recited in claim 7 additionally comprising a plurality of planar members with side support portions for attachment to said corner structures thereby to define a plurality of ports at a plurality of said corner structures.

* * * * *